US007910049B2

(12) United States Patent
Ohanian

(10) Patent No.: US 7,910,049 B2
(45) Date of Patent: Mar. 22, 2011

(54) SYSTEM EMPLOYING GENERATION OF CONTROLLED FURNACE ATMOSPHERES WITHOUT THE USE OF SEPARATE GAS SUPPLIES OR STAND-ALONE ATMOSPHERE GENERATORS

(75) Inventor: Vahe Ohanian, Thornhill (CA)

(73) Assignee: Tempel Steel Company, Chicago, IL (US)

( * ) Notice: Subject to any disclaimer, the term of this patent is extended or adjusted under 35 U.S.C. 154(b) by 0 days.

(21) Appl. No.: 12/644,732

(22) Filed: Dec. 22, 2009

(65) Prior Publication Data

US 2010/0096784 A1 Apr. 22, 2010

Related U.S. Application Data

(62) Division of application No. 11/749,918, filed on May 17, 2007, now Pat. No. 7,648,672.

(51) Int. Cl.
*C21D 1/74* (2006.01)

(52) U.S. Cl. ..... 266/257; 266/242

(58) Field of Classification Search ..... 266/242, 266/200, 78, 257
See application file for complete search history.

(56) References Cited

U.S. PATENT DOCUMENTS

| | | | | |
|---|---|---|---|---|
| 2,706,110 | A | 4/1955 | Ness | |
| 2,799,490 | A | 7/1957 | Rusciano | |
| 3,633,886 | A * | 1/1972 | Froberg | 432/161 |
| 6,495,092 | B1 | 12/2002 | Hazama et al. | |
| 7,578,962 | B2 | 8/2009 | Robertson et al. | |
| 2008/0286708 | A1 | 11/2008 | Ohanian | |

OTHER PUBLICATIONS

Furnace Heating Burner.
Commercial Exothermic Generators.

* cited by examiner

*Primary Examiner* — Scott Kastler
(74) *Attorney, Agent, or Firm* — Schiff Hardin LLP

(57) ABSTRACT

In a system for processing metal, a furnace is provided which receives the metal being processed. At least one heating burner is provided in the furnace together with at least one atmosphere burner of substantially a same construction as the heating burner. An exhaust of the atmosphere burner at least partially provides an atmosphere within the furnace for the metal processing. An exhaust of the heating burner is separate from the exhaust of the atmosphere burner. A fuel feed for the atmosphere burner and a fuel feed for the heating burner are each separately controllable.

12 Claims, 4 Drawing Sheets

FURNACE
10
METAL PRODUCT
14
CONVEYOR
13
EXHAUST MANIFOLD
EXHAUST CHIMNEY
17
16
15
11
12
24
25
18
19
26
20
CONTROL VARIABLES
AIR
COMBUSTION GAS
28
27
22
21
37
34
23
33
29
30
31
35
32
36
GAS COMBUSTION MEASUREMENT SYSTEM
39
38
ACCUMULATOR
CHILLER
40
42
41
VALVE

SYSTEM EMPLOYING GENERATION OF CONTROLLED FURNACE ATMOSPHERES WITHOUT THE USE OF SEPARATE GAS SUPPLIES OR STAND-ALONE ATMOSPHERE GENERATORS

RELATED APPLICATION

The present application is a divisional of U.S. patent application Ser. No. 11/749,918 filed May 17, 2007, issued on Jan. 19, 2010 as U.S. Pat. No. 7,648,672, and titled "Process And System Employing Generation of Controlled Furnace Atmospheres Without The Use Of Separate Gas Supplies Or Stand-Alone Atmosphere Generators", inventor Vahe Ohanian.

BACKGROUND

The properties of metals can be altered by processing at high temperatures where changes in microstructure, chemistry, and surface conditions can occur.

There are many different types of high temperature processes used for treatment of metals which include annealing, sintering, nitriding, carburizing and others. In this application, as an example steel is employed as the metal, although other types of metal could be processed.

In addition to high temperature, one of the common features of all of these processes is a specially controlled atmosphere. The atmosphere is designed specifically for the requirement of the process (carburizing, decarburizing, nitriding), but also prevents any form of oxidation. Thus the function of the atmosphere is to control a specific chemical reaction with the metal.

If steel is processed in air above 400° F., without the advantages of a special or protective atmosphere, oxidation of the surface will occur. In most situations, oxidation of the surface has a deleterious effect on properties and performance of steel, particularly when this occurs at temperatures above 1000° F.

There are several standard methods to create or generate a controlled atmosphere that can be used during thermal processing of steel:

1. pure gas supply from cylinders or tanks;
2. commercially pure gas supply from onsite generation plants, which include examples such as
   a. cryogenic supply for nitrogen, oxygen, hydrogen, argon and helium,
   b. pressure-swing absorption for nitrogen and oxygen,
   c. membrane separation for nitrogen and oxygen, and
   d. electrolytic separation for hydrogen and oxygen;
3. catalytically assisted cracking of chemical feeds e.g. methane, ammonia for hydrogen; and
4. combustion of gas such as natural gas under controlled conditions to produce mixtures of CO, $CO_2$, $H_2$, $H_2O$, and nitrogen—these atmospheres can be described as either exothermic or endothermic depending on the proportion of the components present and the carbon potential of the atmosphere (exothermic atmospheres remove carbon from steel while endothermic atmospheres add carbon to steel) (The words exothermic and endothermic refer to the thermodynamic conditions of the reaction where the free energy of the reaction is either positive or negative, as described by an Ellingham diagram).

The conventional equipment used to generate a standard exothermic or endothermic atmosphere are known as Exothermic Generators and Endothermic Generators. This stand-alone equipment typically comprises:

1. a nozzle or burner for mixture, ignition and combustion of air and a combustion gas where the mixture is directed into a chamber;
2. controls so that the mixture or proportion of air and a combustion gas may be kept within very precise conditions to produce repeatable and consistent mixtures of CO, $CO_2$, $H_2$, $H_2O$, and nitrogen—there is a large body of theory and industrial practice that describes the complexities of this seemingly simple reaction—in steel-making literature, the interrelationship of these components is described as the "Water-Gas Reaction"—control of the temperature of reaction is also extremely important and equipment is most often provided to control the pressure input of the air and natural gas in order to control the temperature of the combustion;
3. the chamber into which the gas mixture is directed is usually water cooled externally, and may or may not include catalysts, heat exchange mediums, and filters—the combustion chamber may be vertical or horizontal;
4. a single or 2-stage heat exchanger and/or chiller in which water vapor can be removed from the combustion gas product—there is normally a filter included as well as drains to allow removal of the condensed water from the combustion atmosphere;
5. analytical equipment to monitor the combustion mixture;
6. a vent or by-pass stack that allows the products of combustion to be vented to atmosphere until such time as the combustion process is stable or the conditions in the actual furnace require addition of atmosphere; and
7. the stand-alone generator is usually rated or described based on the volume of combustion gas produced per hour.

Such stand-alone generators are usually characterized by:

1. relatively large use of cooling water which normally requires additional chilling, cooling, etc. for recirculation or, in the worst cases, direct discharge to a drain;
2. relatively high maintenance costs;
3. instability of the composition of the combustion gas mixture—very small differences in either temperature of combustion or proportion of air and natural gas can have a large effect on the products of combustion and, as a result, on the stability or lack of stability of the reaction from the atmosphere;

and 4. relatively low costs when compared to the supply of pure gases, either directly or by generation.

Heating of the metal processing furnace may be achieved by electric resistance elements or by the combustion of natural gas within sealed burners. In most cases where the atmosphere in the metal processing furnace is required to perform a specific chemical reaction, other than simple heating, the atmosphere for combustion of the burners is completely separated from the special atmosphere used inside the metal processing furnace. This is because the combustion of air and gas for maximum heat generation in the burner provides an atmosphere composition that is not suitable for either exothermic or endothermic processing in the metal processing furnace.

SUMMARY

It is an object to generate a controlled metal processing furnace atmosphere substantially without the use of separate gas supplies or stand-alone atmosphere generators.

In a system for processing metal, a furnace is provided which receives the metal being processed. At least one heating burner is provided in the furnace together with at least one atmosphere burner of substantially a same construction as the heating burner. An exhaust of the atmosphere burner at least partially provides an atmosphere within the furnace for the metal processing. An exhaust of the heating burner is separate from the exhaust of the atmosphere burner. A fuel feed for the atmosphere burner and a fuel feed for the heating burner are each separately controllable.

DESCRIPTION OF THE PREFERRED EMBODIMENT

Figure 1:
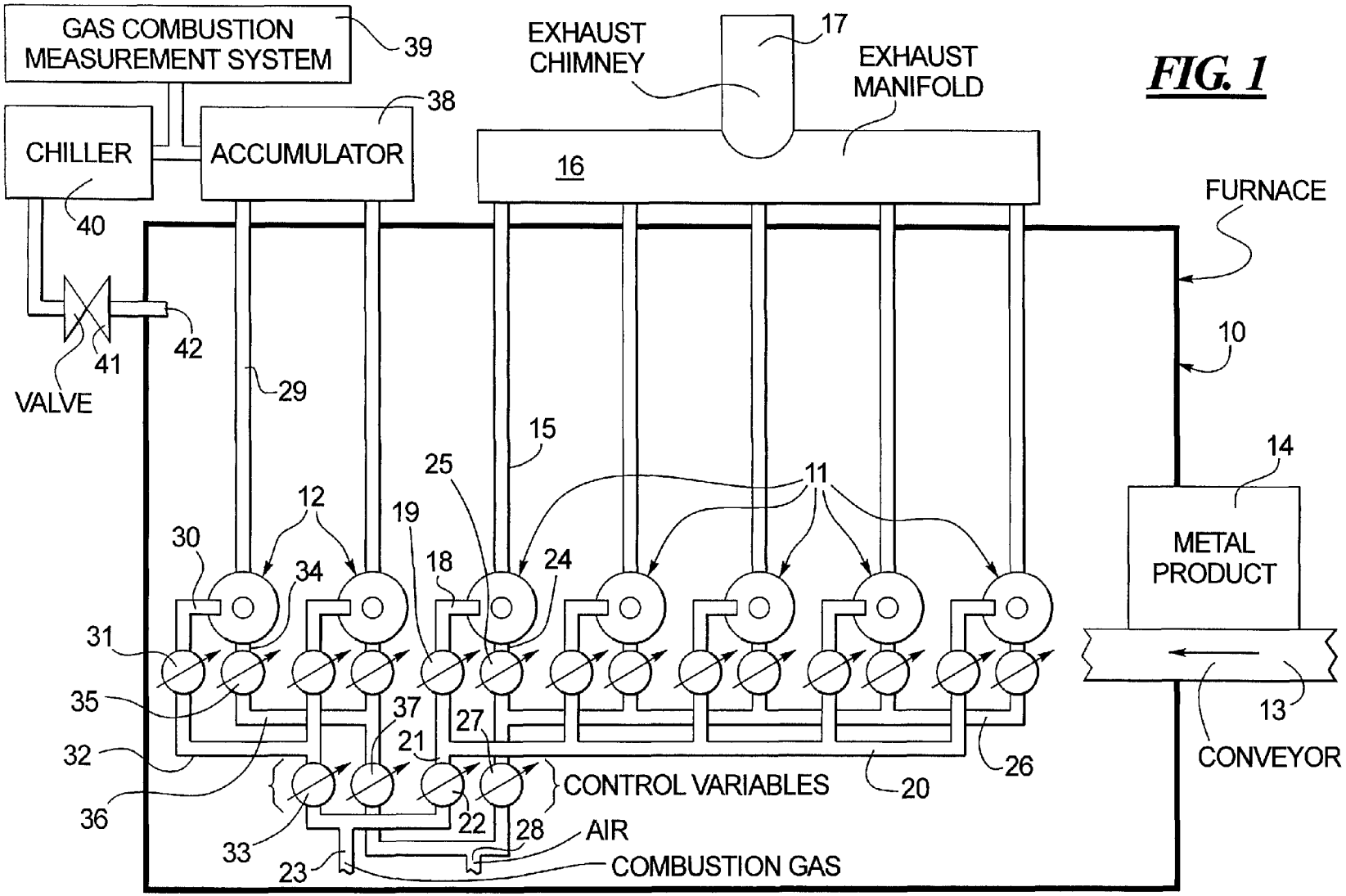
FIG. 1 is a side view of a metal processing furnace in which some of the original heating burners have been converted to atmosphere burners in accordance with the preferred embodiment.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

The preferred embodiment relates to furnaces for metal processing where heating is achieved using a combustion of air and a combustion gas (including equivalent heat sources such as natural gas, propane, LPG etc. or other hydrocarbons, etc.) in a sealed burner where the exhaust may be captured. In the preferred embodiment the metal processing furnace (here for steel) is heated by a number of burners. The burners in the furnace are normally tuned to give maximum heat generation and to provide complete combustion without generation of smoke or soot. The products of combustion are preferably collected into a common header or exhaust and vented to atmosphere.

The preferred embodiment uses to create the furnace atmosphere a specific number of the burners which may already exist in an existing furnace (the existing burners are hereinafter known as the "original burners" and which are used to heat the furnace by combustion of air and combustion gas. The specific burners which are now used instead to create the furnace atmosphere will be referred to hereinafter as "atmosphere burners" to identify and separate their function from the original burners still to be used for heating the metal processing furnace. Those original burners still to be used for heating will be indicated hereinafter by the term "heating burners"). The choice of the number of atmosphere burners depends on the requirements for the volume flow rate of the furnace atmosphere. However, the following changes are made to existing or standard equipment:

1. The controls for supply of air and the combustion gas to original burners now to be used as the atmosphere burners are separated from the controls used for the remainder of the burners to be used as the heating burners. This allows the atmosphere burners to be adjusted and controlled separately from the heating burners. The separate controls on the atmosphere burners allow control for the type of atmosphere needed.

2. Usually, the atmosphere burners are selected from the array of the original burners at the front end of the furnace if the furnace is in the form of a continuous processing furnace. However, they can be selected from any of the original burners, regardless of location.

3. The exhaust atmosphere from each of the atmosphere burners is separated from the piping used to collect the exhaust atmosphere from the heating burners.

4. The controls for air and the combustion gas for the atmosphere burners are adjusted for both volume and pressure. These controls for air and combustion gas are used to form in the case of an exothermic atmosphere a mixture typically ranging from "lean" to "rich" as required by the application. To form a "rich" atmosphere in the case of an exothermic atmosphere resulting in a combustion mixture, the components typically are as follows for natural gas, for example:

| | |
|---|---|
| CO | 9% |
| CO2 | 5% |
| H2 | 9 to 11% |
| H2O | controlled by the temperature of cooling |
| CH4 | 0.5% (methane) |
| N2 | balance |
| O2 | <0.10% |

5. Separate piping is provided for each atmosphere burner to collect the exhaust or combustion product and to collect this into a common containment chamber for mixing, for partial removal of heat, and to avoid any differential back pressure that might affect the stability of the atmosphere burners. The temperature of the exothermic atmosphere is typically 1000° F. at the point of exit from the burners and may be 800° F. at the point of entry into the containment chamber.

6. Special analytical equipment may be provided to be able to continuously monitor gas composition such as, for example % $H_2$, % CO and % $CO_2$, or other compositions.

7. The exothermic combustion atmosphere is piped from the containment chamber to a heat exchanger/s also known as a chiller herein. This may be designed as a combination of finned tubes together with a water-cooled heat exchanger and/or chiller. A separator is added at the end of the heat exchanger equipment such that condensed water can be removed from the atmosphere without introduction of air. The temperature of the exothermic atmosphere after passage through the heat exchanger will typically be 35° F. to 55° F. and becomes a direct control for the subsequent oxidation potential of the atmosphere.

8. The exothermic atmosphere is piped to a by-pass or vent stack such that the atmosphere can be discharged to air if the furnace conditions or the exothermic atmosphere composition are not satisfactory.

9. The exothermic atmosphere is then piped to the furnace through the aforementioned chiller to dry out the atmosphere as needed, and to a safety valve that allows introduction of the atmosphere to the furnace only when the temperature of the furnace exceeds the auto-ignition temperature for hydrogen atmospheres.

Although an exothermic preferred embodiment is described, the atmosphere may also be endothermic.

Although the preferred embodiment described thus far is discussed in terms of an existing furnace which is later retrofitted by converting some of the original burners to atmosphere burners, the concept of the preferred embodiment is also suitable for new furnace construction. In this case, the new furnace would be constructed like the structure described above for the retrofitted existing furnace.

The preferred embodiment will now be explained in greater detail. As shown in FIG. 1, a furnace 10 prior to conversion has a set of existing original burners, in this case seven, although the furnace may have different numbers of original burners. In the case of this example, two of the original burners are converted to atmosphere burners although any number of such original heating burners may be converted to the atmosphere burners. In this example, there are five original heating burners which remain as heating burners 11. Two of the original burners are converted to atmosphere burners and are indicated at 12. A conveyor 13 conveys a metal product 14 into the furnace. This metal product may be steel, for example, but may be many other kinds of metals.

Figure 2:
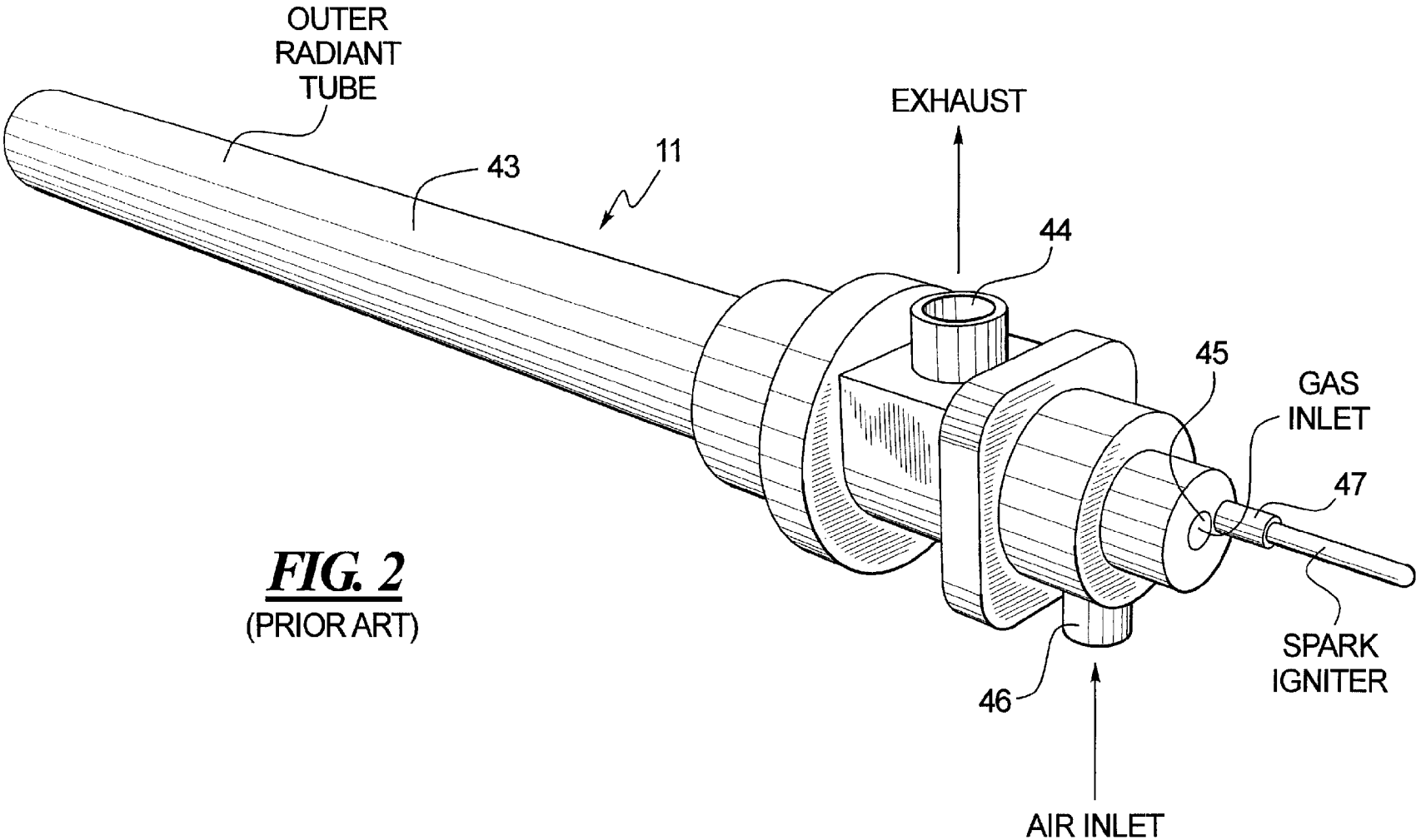
FIG. 2 (PRIOR ART)
FIG. 2 is a perspective view of one of the original burners which may be a heating burner or a converted atmosphere burner according to the preferred embodiment.

Connections to one of the heating burners 11 will now be described although these connections are the same for the other heating burners 11. An exhaust pipe 15 connects an exhaust output 44 (FIG. 2) to an exhaust manifold 16 which is preferably horizontal. Of course many other structure types and shapes may be employed for the exhaust manifold. The exhaust manifold connects to an exhaust 17, such as an exhaust chimney for example. A combustion gas input line 18 feeds gas to the gas inlet 45 of the burner (FIG. 2). A spark igniter 47 as shown in FIG. 2 is located near the gas inlet 45.

The gas inlet is controlled by an individual control valve 19 connecting to a common line 20. The common line 20 is connected by an output line or pipe 21 from a common control valve 22. The common control valve 22 connects to a combustion gas inlet at 23.

For the atmosphere burners 12, only one will be described, although the description applies to each atmosphere burner. The atmosphere burner has a construction also shown in FIG. 2 since it is a converted heating burner. Thus the combustion gas enters at pipe 30 at the gas inlet 45. This gas inlet is controlled by valve 31 connected to common pipe or line 32. This common pipe or line is connected to the output of a common control valve 33 for the atmosphere burners. The input to the valve 33 is connected to the combustion gas inlet 23.

The atmosphere burner 12 has an input line 24 for air connected to the air inlet 46. This inlet is connected to an individual control valve 35 connecting to a common pipe section 36 which is fed by the output of the common control valve 37. A common control valve 37 connects to the air inlet 28.

Figure 3:
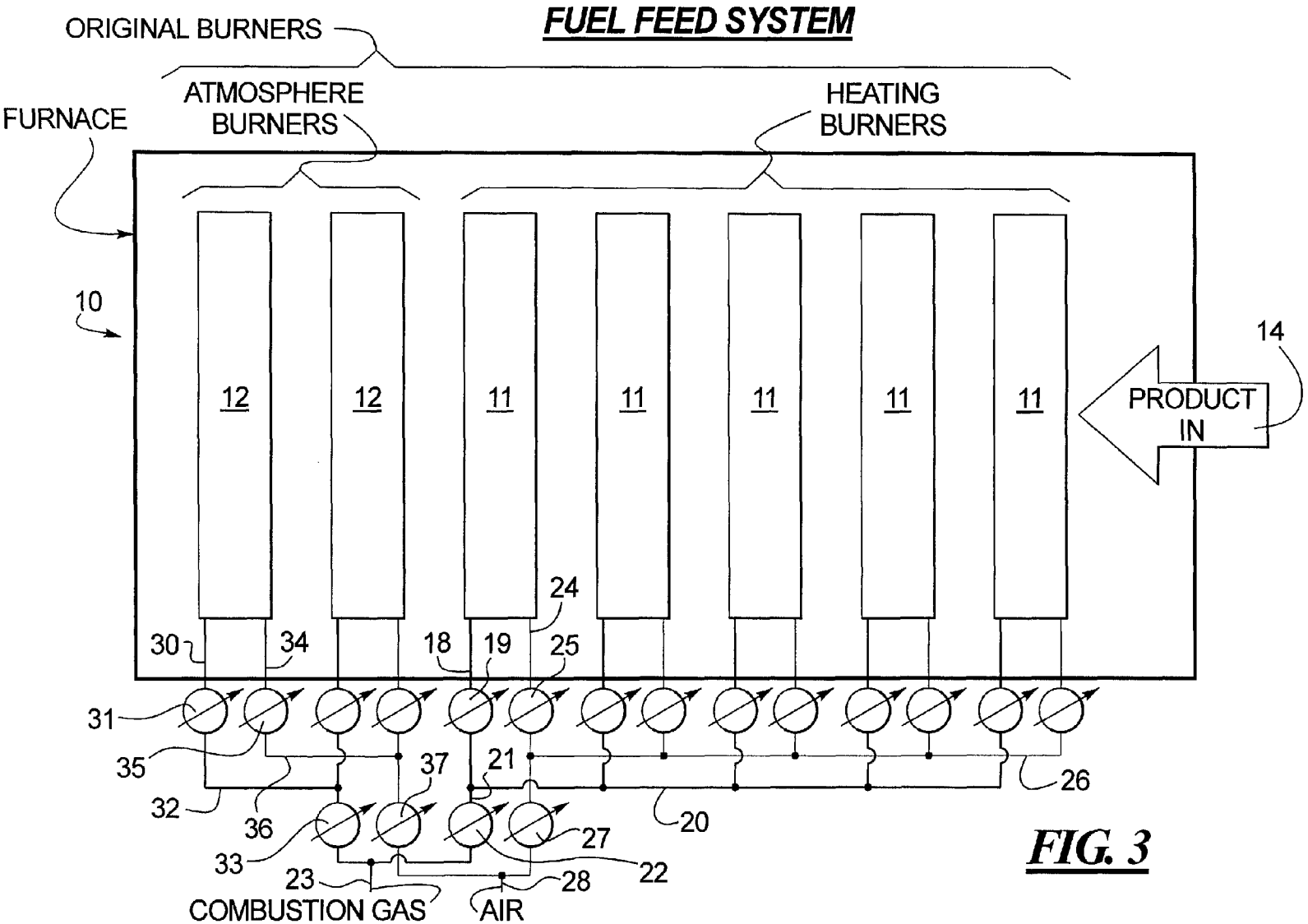
FIG. 3 is a schematic illustration of the furnace of FIG. 1 showing the fuel feed system.
Figure 4:
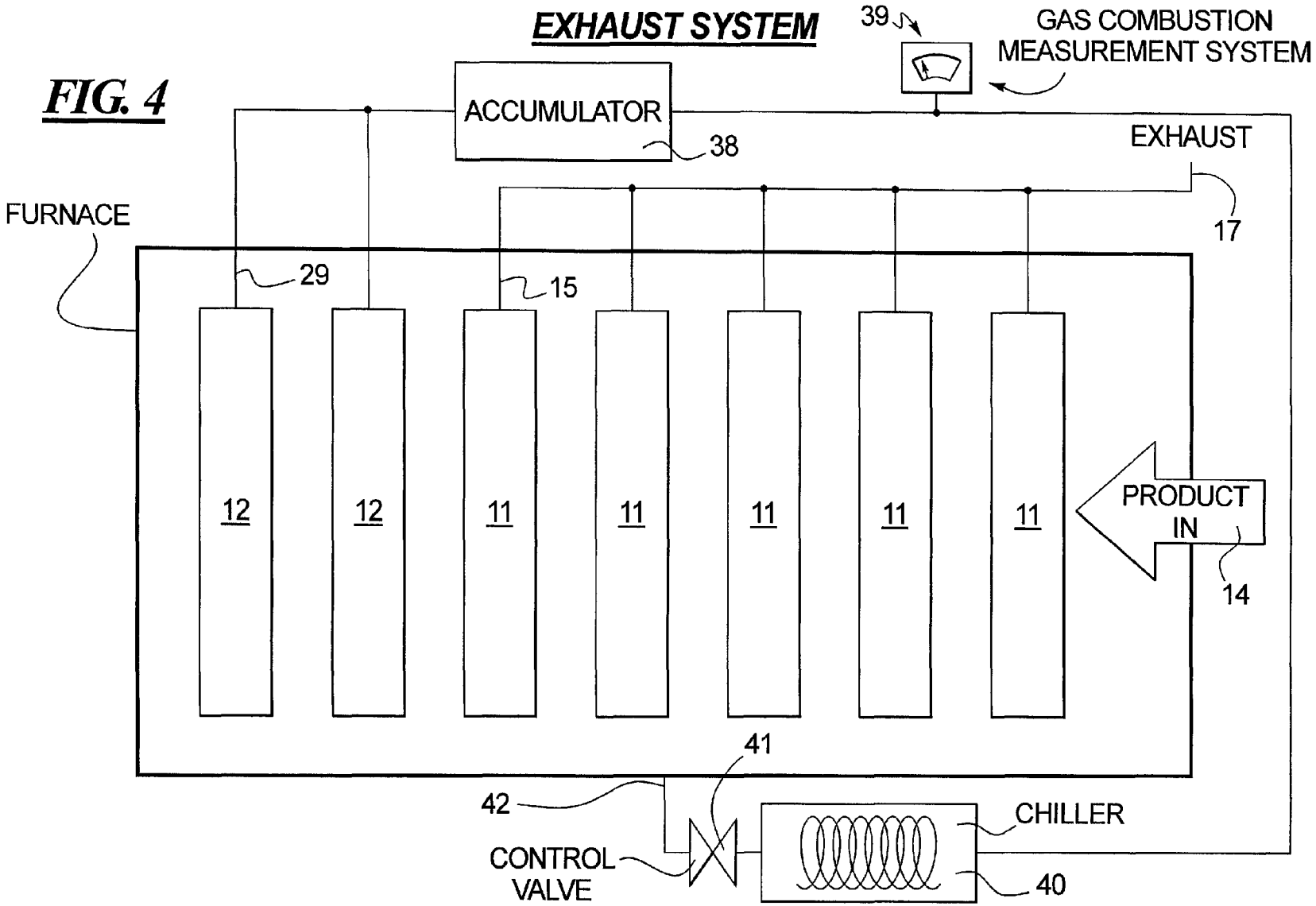
FIG. 4 is a schematic illustration of FIG. 1 but showing the exhaust system.

As may be appreciated and described hereafter in relation to FIGS. 3 and 4, the fuel feed system for the atmosphere burners is separate from the fuel feed system for the heating burners and the systems are separately controllable. Also the exhaust system for the atmosphere burners is separate from the exhaust system for the heating burners. The independent exhaust and fuel feed systems for the atmosphere burners are constructed when converting some of the original existing heating burners to the atmosphere burners.

Also as part of the conversion is the connection of the exhaust 29 from the atmosphere burner to the accumulator 38. The accumulator 38 outputs to a chiller 40. A gas combustion measurement system 39 monitors the exhaust gases between the accumulator and the chiller.

The chiller 40 outputs through a control valve 41 to an output 42 in the furnace 10. This valve is for safety purposes and also adjusts the furnace atmosphere concentration/volume.

Even though FIG. 1 has been described above as relating to an existing furnace being converted, the preferred embodiment of FIG. 1 may also relate to a new furnace constructed as described.

The gas combustion measurement system 19 may in the preferred embodiment comprise a balanced pressure sensitive box. Of course other systems may also be employed for the gas combustion measurement system.

The accumulator 38 is preferably a chamber such as a pressure sensitive box 12 which accumulates the exhaust gases from the atmosphere burners in combination. The chiller 40 is preferably a heat exchanger which chills the gases as appropriate for creating the desired atmosphere in the furnace as previously described. Of course other types of chillers or accumulators may be employed. The accumulator may also be possibly eliminated.

FIG. 2 shows a perspective view at one example of one kind of burner which may be employed in the existing furnace prior to conversion. The heating burner and the atmosphere burner are the same as shown in FIG. 2. The FIG. 2 burner was previously described when describing FIG. 1. It should be appreciated that many other types of burners may be used of varying different kinds of construction depending on the particular furnace being converted.

As previously mentioned, FIG. 3 is a schematic illustration showing the separate fuel feed systems of FIG. 1 but in simplified schematic format. Similarly, FIG. 4 shows the separate exhaust systems of FIG. 1 but in simplified schematic format.

The preferred embodiment has the following benefits:

1. While the exothermic atmosphere burners are not tuned for maximum heat production, they still provide heat input to the furnace that has to be removed using water cooling in the case of a stand-alone generator. Thus the volume of cooling water used for the preferred embodiment is greatly reduced and the heat generated in the atmosphere burners is added to the thermal process rather than being lost.

2. The use of some of the existing original burners within the furnace for the atmosphere burners eliminates the requirement for a large separate area for the furnace atmosphere generator and associated water cooling equipment.

3. The use of some of the existing original burners within the furnace for the atmosphere burners eliminates the cost for a separate generator combustion chamber and associated control equipment.

4. The ability to select any number of existing original burners for conversion to the atmosphere burners at any location within the furnace allows for flexibility in the choice of atmosphere volumes and simplicity of piping.

5. Control equipment for the atmosphere burners is the same as the control equipment for the heating burners and requires only the addition of modest analytical equipment.

As previously indicated, there are many variations to the components described in the preferred embodiment. The burners may be of various different designs. Any number of original heater burners may be converted to atmosphere burners. The accumulator may be of many different shapes and forms. Similarly the chiller may be of various designs as may be the gas combustion measurement system.

As previously mentioned, the burners may be of a wide variety of designs as may be the individual and common controls and other types of individual and common control layouts may be provided for the atmosphere and heater burners.

The exhaust manifold may be provided with different shapes and orientations and it would even be possible that the exhaust from the heater burners could directly exhaust to a chimney without use of an exhaust manifold, although use of an exhaust manifold is useful.

The location of the valve 41 is also variable and many different types of valves may be provided. Also the valve 41 may be controlled in many different ways. For example, an output of the gas combustion measurement system may be used to control the valve 41 and/or manual controls may be used to control valve 41. A computer may also be used to control valve 41 based on various parameters. It is also possible that a computer can be used to control the individual and common control valves along with control of valve 41.

Although steel has been disclosed herein as one type of metal product being processed, various kinds and compositions of metal products may be processed.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

I claim as my invention:

1. A system for processing metal, comprising:

a furnace which receives the metal being processed;

at least one heating burner in the furnace;

at least one atmosphere burner in the furnace which is of substantially a same construction as the heating burner;

an exhaust of the atmosphere burner being conveyed outside the furnace and then being fed back into the furnace for at least partially providing an atmosphere within the furnace chamber for the metal processing;

an exhaust of the heating burner is separate from and is not connected to the exhaust of the atmosphere burner; and a fuel feed for the atmosphere burner and a fuel feed for the heating burner each being separately controllable.

2. A system of claim 1 wherein the atmosphere burner and the heating burner lie adjacent to one another at one side of the furnace.

3. A system of claim 1 wherein the exhaust of the heating burner is conveyed to a chimney.

4. A system of claim 1 wherein a plurality of heating burners are provided each of which have an exhaust conveyed to a common exhaust manifold, and the exhaust manifold having a common exhaust outlet.

5. A system of claim 1 wherein the exhaust of the atmosphere burner is measured by a gas combustion measurement system.

6. A system of claim 5 wherein the gas combustion measurement system controls a valve which feeds the atmosphere burner exhaust back into the furnace.

7. A system of claim 1 wherein a chiller is provided outside of the furnace and receiving the exhaust from the atmosphere burner and an output of which connects through a control valve to an inside of the furnace to feed the exhaust back into the furnace.

8. A system of claim 7 wherein the chiller comprises a heat exchanger.

9. A system of claim 1 wherein the fuel feed for the atmosphere burner comprises both combustion gas and air and wherein an adjustable control is provided for the air and another adjustable control is provided for the combustion gas.

10. A system of claim 1 wherein the heating burner fuel feed comprises combustion gas and air and wherein a separate control is provided for the combustion gas and another separate control is provided for the air.

11. A system of claim 1 wherein at least two atmosphere burners are provided and at least two heating burners are provided, the fuel feed for each comprising air and combustion gas, and wherein a common control controls the air to both of the atmosphere burners and individual controls are provided for each atmosphere burner for the air, the combustion gas is controlled by a separate common control and two separate individual controls to each of the at least two atmosphere burners, and wherein a common control is provided for the air to the two heating burners, another common control is provided for the combustion gas to the heating burners, and wherein individual controls are provided for the air and the gas for each of the individual heating burners.

12. A system for processing metal, comprising:

a furnace which receives the metal being processed;

at least one heating burner in the furnace;

at least one atmosphere burner in the furnace;

an exhaust of the atmosphere burner being conveyed outside the furnace and then being fed back into the furnace for at least partially providing an atmosphere within the furnace chamber for the metal processing;

an exhaust of the heating burner is separate from and is not connected to the exhaust of the atmosphere burner; and a fuel feed for the atmosphere burner and a fuel feed for the heating burner each being separately controllable.

* * * * *